US010737168B2

(12) United States Patent
Contant et al.

(10) Patent No.: US 10,737,168 B2
(45) Date of Patent: Aug. 11, 2020

(54) LEG PAD FOR A HOCKEY PLAYER

(71) Applicant: BAUER HOCKEY, LLC, Exeter, NH (US)

(72) Inventors: Mathieu Contant, Verdun (CA); Jean-Francois Laperriere, Prevost (CA); Marco Beauregard, Morin-Heights (CA); Marie-Claude Genereux, Sainte-Therese (CA)

(73) Assignee: BAUER HOCKEY, LLC, Exeter, NH (US)

( * ) Notice: Subject to any disclaimer, the term of this patent is extended or adjusted under 35 U.S.C. 154(b) by 0 days.

(21) Appl. No.: 16/158,747

(22) Filed: Oct. 12, 2018

(65) Prior Publication Data

US 2019/0038956 A1 Feb. 7, 2019

Related U.S. Application Data

(63) Continuation of application No. 14/837,598, filed on Aug. 27, 2015, now Pat. No. 10,124,237, which is a (Continued)

(51) Int. Cl.
*A63B 71/12* (2006.01)
*A41D 13/05* (2006.01)
(Continued)

(52) U.S. Cl.
CPC ..... *A63B 71/1225* (2013.01); *A41D 13/0543* (2013.01); *A63B 2071/125* (2013.01); (Continued)

(58) Field of Classification Search
CPC ..... A63B 71/1225; A63B 2102/24; A63B 2102/22; A63B 2071/125; (Continued)

(56) References Cited

U.S. PATENT DOCUMENTS 1,624,129 A 4/1927 Barrett
1,777,088 A 9/1930 Horath
(Continued)

FOREIGN PATENT DOCUMENTS

CA 2777785 11/2013

OTHER PUBLICATIONS

Notice of Allowance issued by the USPTO dated Jun. 18, 2013 in connection with U.S. Appl. No. 13/475,395.
(Continued)

*Primary Examiner* — Amy Vanatta
(74) *Attorney, Agent, or Firm* — Smart and Biggar LLP

(57) ABSTRACT

The invention relates to a leg pad for a hockey player. The leg pad extends along a longitudinal axis and comprises an upper portion, a bottom portion and a band. The upper portion has a knee cap for covering a knee joint of the player. The bottom portion has an upper shell for covering a substantial part of a shin of the hockey player and a lower shell for at least partially covering the shin and ankle of the hockey player. The band extends along part of a periphery of the upper shell and part of a periphery of the lower shell. The band interconnects the upper shell and the lower shell to one another wherein the lower shell is movable relative to the upper shell between a first position and a second position in response to flexion of the ankle.

23 Claims, 6 Drawing Sheets

Related U.S. Application Data continuation of application No. 13/953,251, filed on Jul. 29, 2013, now Pat. No. 9,132,335, which is a continuation of application No. 13/475,395, filed on May 18, 2012, now Pat. No. 8,510,862.

(51) Int. Cl.
*A63B 102/24* (2015.01)
*A63B 102/22* (2015.01)

(52) U.S. Cl.
CPC ..... *A63B 2071/1258* (2013.01); *A63B 2071/1275* (2013.01); *A63B 2102/22* (2015.10); *A63B 2102/24* (2015.10)

(58) Field of Classification Search
CPC .... A63B 2071/1258; A63B 2071/1275; A63B 2071/1283; A41D 13/0543; A41D 13/055; A41D 13/06; A41D 13/065; A41D 13/08; A61F 2005/0146; A61F 5/0102; A61F 2005/0172
See application file for complete search history.

(56) References Cited

U.S. PATENT DOCUMENTS

| | | | | |
|---|---|---|---|---|
| 2,982,968 | A | 5/1961 | Groot | |
| 3,135,964 | A | 6/1964 | Pender | |
| 3,761,960 | A | 10/1973 | Woodcock | |
| 3,772,704 | A | 11/1973 | Carbonneau | |
| 4,633,529 | A | 1/1987 | Litz | |
| 4,674,157 | A | 6/1987 | Litz | |
| 4,692,946 | A | 9/1987 | Jurga | |
| 4,698,845 | A | 10/1987 | Cosby | |
| 4,751,748 | A * | 6/1988 | Ekins | A63B 71/1225 2/22 |
| D297,178 | S | 8/1988 | Jurga | |
| 4,876,745 | A | 10/1989 | Richards | |
| 4,888,826 | A | 12/1989 | Parsons | |
| 5,477,559 | A * | 12/1995 | Clement | A63B 71/1225 2/22 |
| 5,507,720 | A | 4/1996 | Lampropoulos | |
| 5,662,594 | A | 9/1997 | Rosenblatt | |
| 5,732,411 | A | 3/1998 | Coleman | |
| 5,742,938 | A | 4/1998 | Winningham | |
| 5,806,092 | A | 9/1998 | Shikatani | |
| 5,898,939 | A | 5/1999 | Schramm | |
| 6,128,779 | A | 10/2000 | Goldsmith | |
| 6,131,195 | A | 10/2000 | Foreman | |
| 6,178,555 | B1 | 1/2001 | Williams | |
| 6,178,556 | B1 | 1/2001 | Foreman | |
| 6,560,781 | B1 | 5/2003 | Keene | |
| 6,654,961 | B2 | 12/2003 | Beland | |
| 6,687,912 | B2 | 2/2004 | Collins | |
| D501,690 | S | 2/2005 | Chen | |
| 6,912,729 | B2 | 7/2005 | Nishimoto | |
| 6,964,062 | B1 | 11/2005 | Chen | |
| 7,188,370 | B2 | 3/2007 | Bevier | |
| 7,797,760 | B2 | 9/2010 | Morrow | |
| 7,797,764 | B2 | 9/2010 | Norris | |
| 7,832,017 | B2 | 11/2010 | Nascimento | |
| 7,845,017 | B2 | 12/2010 | Godshaw | |
| 8,510,862 | B1 | 8/2013 | Contant | |
| 9,132,335 | B2 | 9/2015 | Contant | |
| 10,124,237 | B2 | 11/2018 | Contant | |
| 2004/0083527 | A1 | 5/2004 | Budda | |
| 2005/0015841 | A1 | 1/2005 | Hoffman | |
| 2005/0246812 | A1 | 11/2005 | Bevier | |
| 2006/0107433 | A1 | 5/2006 | Olson | |
| 2007/0250977 | A1 | 11/2007 | Brown | |
| 2008/0120756 | A1 | 5/2008 | Shepherd | |
| 2009/0025114 | A1 | 1/2009 | Hudon | |
| 2010/0107291 | A1 | 5/2010 | Carter | |
| 2010/0229276 | A1 | 9/2010 | Bevier | |

OTHER PUBLICATIONS

Examiner's Report issued by CIPO dated Oct. 23, 2014 in connection with CA patent application No. 2,777,785.
Examiner's Report issued by CIPO dated Nov. 5, 2014 in connection with CA patent application No. 2,777,785.
Non-Final Office Action issued by the USPTO dated Jan. 16, 2015 in connection with U.S. Appl. No. 13/953,251.
Examiner's Report issued by CIPO dated Mar. 13, 2015 in connection with CA patent application No. 2,777,785.
Notice of Allowance issued by the USPTO dated May 11, 2015 in connection with U.S. Appl. No. 13/953,251.
Examiner's Report issued by CIPO dated Jul. 22, 2015 in connection with CA patent application No. 2,777,785.
Notice of Allowance issued by CIPO dated Dec. 2, 2015 in connection with CA patent application No. 2,777,785.
Non-Final Office Action issued by the USPTO dated Apr. 8, 2016 in connection with U.S. Appl. No. 14/837,598.
Final Office Action issued by the USPTO dated Oct. 14, 2016 in connection with U.S. Appl. No. 14/837,598.
Non-Final Office Action issued by the USPTO dated Mar. 9, 2017 in connection with U.S. Appl. No. 14/837,598.
Final Office Action issued by the USPTO dated Oct. 16, 2017 in connection with U.S. Appl. No. 14/837,598.
Advisory Action dated Jan. 30, 2018 in connection with U.S. Appl. No. 14/837,598.
Non-Final Office Action issued by the USPTO dated Mar. 7, 2018 in connection with U.S. Appl. No. 14/837,598.
Examiner's Report issued by CIPO dated Apr. 3, 2018 in connection with CA patent application No. 2,931,819.
Notice of Allowance issued by the USPTO dated Jul. 12, 2018 in connection with U.S. Appl. No. 14/837,598.

* cited by examiner

LEG PAD FOR A HOCKEY PLAYER

FIELD OF THE INVENTION

The present invention relates to a leg pad for a hockey player. The leg pad provides adequate protection and flexion in the ankle region of the player.

BACKGROUND OF THE INVENTION

In recent years, sporting equipment has been evolving to accommodate the need for increased protection. Due to the competitive and aggressive nature of some sports, it has been an objective of sports equipment makers to improve protective gear all the while permitting flexibility and comfort for the player. However, in many cases, an increase in protection can lead to a decrease in maneuverability due to the rigidity of the protective material.

Conventional hockey leg pads generally comprise two protective portions. One portion is located in the knee region and the other portion generally protects the shin region. However, depending on the length of the shin protecting region, the ankle may not be adequately protected. In cases where the shin protecting region substantially overlaps the ankle, the player may exhibit discomfort while moving and skating due to the obstructive nature of the rigid protective material at the bottom part of the leg pad. More specifically, the player may experience a limited range of motion in occurrences that require flexing the player's ankle. On the other hand, should the player need a greater range of motion in the ankle region, the player may use a shorter leg pad, but a part of the ankle or forefoot may then be exposed.

There is therefore a need for a hockey leg pad providing adequate protection in the ankle region and having an upper shell and a lower shell is movable relative to the upper shell. According to one feature, a band interconnects the lower shell to the upper shell such that the lower shell is movable between a first position and a second position in response to flexion of the ankle. The bottom part of the upper shell and the top part of the lower shell may overlap when the lower shell is in the first position.

SUMMARY OF HE INVENTION

According to one aspect of the present invention, there is provided a leg pad for a hockey player. The leg pad extends along a longitudinal axis and comprises an upper portion, a bottom portion and a band. The upper portion has a knee cap for covering a knee joint of the player. The bottom portion has an upper shell for covering a substantial part of a shin of the hockey player and a lower shell for at least partially covering the shin and ankle of the hockey player. The band extends along part of a periphery of the upper shell and part of a periphery of the lower shell. The band interconnects the upper shell and the lower shell to one another wherein the lower shell is movable relative to the upper shell between a first position and a second position in response to flexion of the ankle.

According to another aspect of the present invention, there is provided a leg pad for a hockey player. The leg pad extends along a longitudinal axis and comprises an upper portion, a bottom portion and a band. The upper portion comprises a knee cap for covering a knee joint of the player. The bottom portion has an upper shell for covering a substantial part of a shin of the hockey player and a lower shell for at least partially covering the shin and ankle of the hockey player. The band extends along part of a periphery of the upper shell and part of a periphery of the lower shell. The band interconnects the lower shell to the upper shell such that the lower shell is movable between a first position and a second position in response to flexion of the ankle. The upper shell and the lower shell overlap when the lower shell is in the first position.

This and other aspects and features of the present invention will now become apparent to those of ordinary skill in the art upon review of the following description of specific embodiments of the invention and the accompanying drawings.

BRIEF DESCRIPTION OF THE DRAWINGS

A detailed description of embodiments of the present invention is provided hereinbelow with reference to the following drawings, in which.

Figure 1:
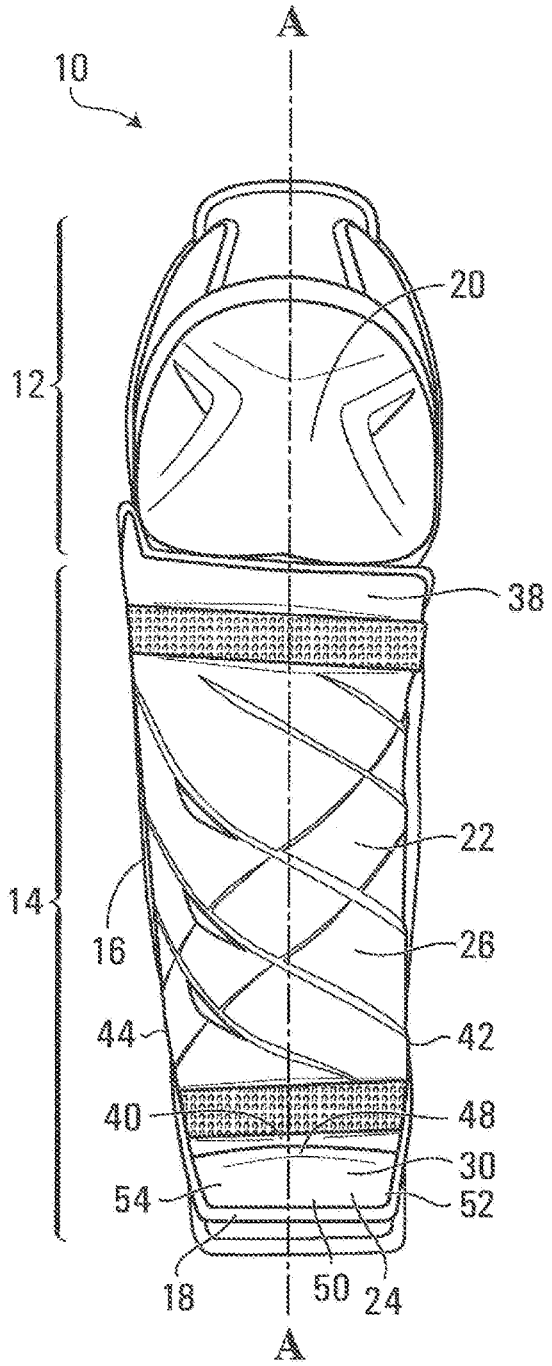
FIG. 1 is a front view of a leg pad in accordance with an embodiment of the invention.

In the drawings, embodiments of the invention are illustrated by way of example. It is to be expressly understood that the description and drawings are only for purposes of illustration and as an aid to understanding, and are not intended to be a definition of the limits of the invention.

DETAILED DESCRIPTION OF THE EMBODIMENTS OF THE INVENTION

To facilitate the description, any reference numeral designating an element in one figure will designate the same element if used in any other figures. In describing the embodiments, specific terminology is resorted to for the sake of clarity but the invention is not intended to be limited to the specific terms so selected, and it is understood that each specific term comprises all equivalents.

Unless otherwise indicated, the drawings are intended to be read together with the specification, and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure. Similarly, the terms "inwardly," "outwardly" and "radially" generally refer to the orientation of a surface relative to its axis of elongation, or axis of rotation, as appropriate.

Figure 2:
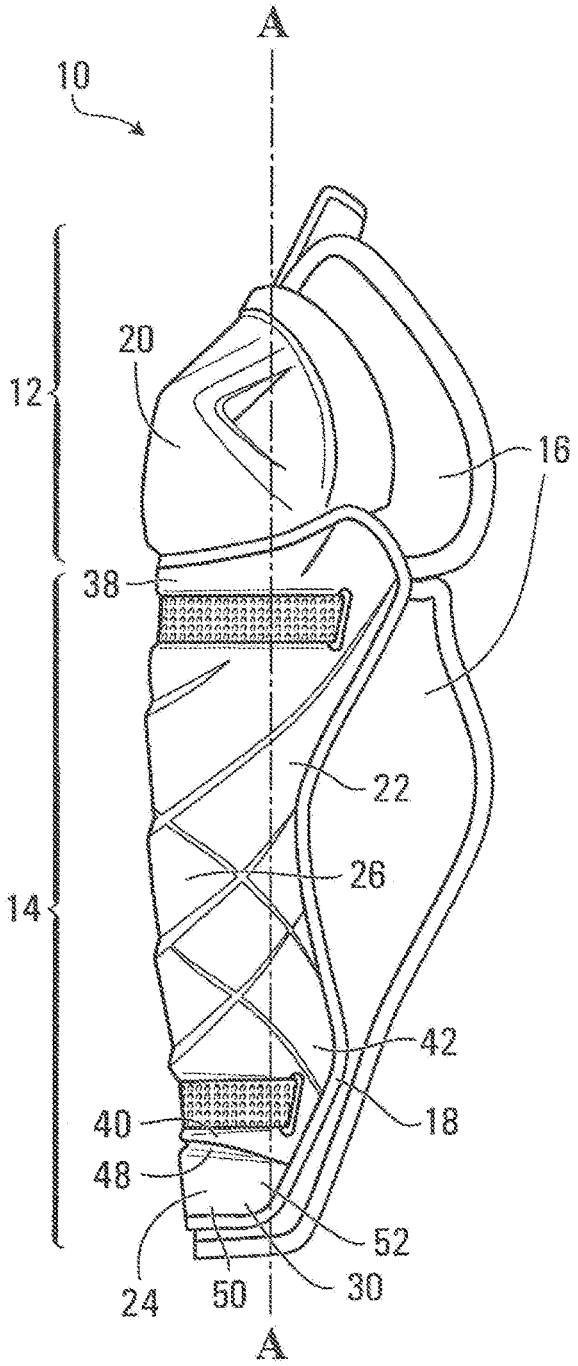
FIG. 2 is a side view of the leg pad of FIG. 1.

With reference to FIGS. 1 and 2, there is shown a non-limiting example of a leg pad 10 in accordance with the invention. The leg pad 10 extends along a longitudinal axis A-A and comprises an upper portion 12, a bottom portion 14, a liner 16 and a band 18. The upper portion 12 comprises a knee cap 20 for protecting the knee of a player's leg. The bottom portion 14 comprises an upper shell 22 and a lower shell 24.

Figure 3A:
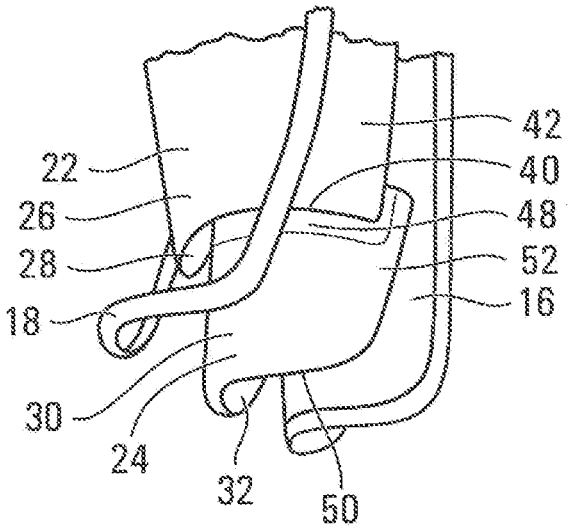
FIG. 3A is an enlarged exploded perspective view of the bottom portion of the leg pad.
Figure 3B:
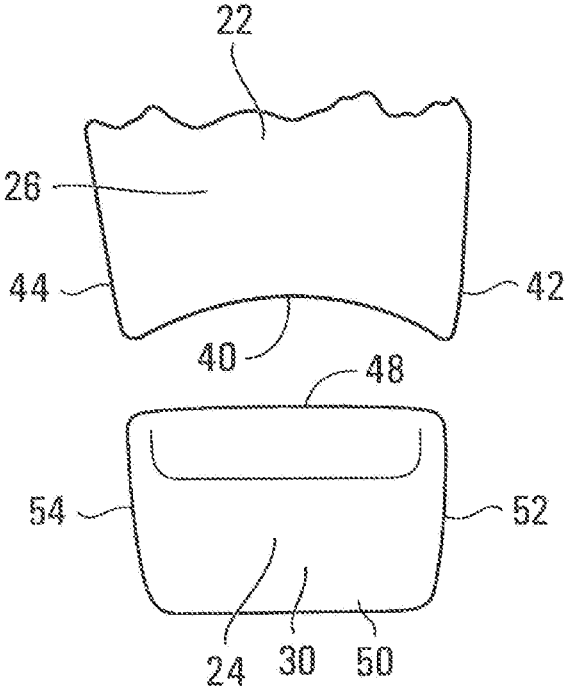
FIG. 3B is an enlarged exploded front view of the bottom portion of the leg pad showing only the upper shell and the lower shell.

With reference to FIGS. 3A and 3B, the upper shell 22 and the lower shell 24 are shown in more detail. The upper shell 22 has an outer side 26 and an inner side 28, the outer side 26 being opposed to the inner side 28. The lower shell 24 has an outer side 30 and an inner side 32, the outer side 30 being opposed to the inner side 32.

The upper shell 22 also comprises a top edge 38, a bottom edge 40, a left edge 42 and a right edge 44 and the lower shell 24 also comprises a top edge 48, a bottom edge 50, a left edge 52 and a right edge 54. The upper shell 22 substantially protects the shin portion of a player's leg and the lower shell 24 substantially protects the ankle portion of a player's leg. More specifically, the lower shell 24 covers the lower front part of the player's ankle and may also cover the player's forefoot.

The upper and lower shells 22, 24 may be made of a rigid plastic material for providing adequate protection in case of impact with a stick, a puck, or collisions with another player for example. It is known in the art that hockey leg shells can be made of NYLON, polycarbonate materials, thermoplastics, thermosetting resins, polyethylene, high density polyethylene (HDPE), polypropylene or any other suitable material. In one embodiment, the upper shell 22 and the lower shell 24 may be formed of the same material. In another embodiment, the upper shell 22 and the lower shell 24 may be formed of different materials. In yet another embodiment the upper shell 22 and the lower shell 24 may each comprise a combination of at least two materials. The upper and lower shells 22, 24 may be manufactured or shaped via any method that is known in the art. For example, the upper and lower shells 22, 24 may be molded or thermoformed.

The liner 16 is mounted under the upper and lower shells 22, 24 and is adapted to be disposed between the upper and lower shells 22, 24 and the player's shin and ankle. The liner 16 may be made of any suitable material or composition or materials that provide the degree of cushioning and protection that is desired. The liner 16 may be made of a soft material such as foam, polyethylene, low density polyethylene (LDPE) or any other suitable material. The liner 16 may also be made of foam material covered by layers of woven synthetic yarn, such as closed cell foam of ethylene vinyl acetate covered by a mesh outer layer of a woven synthetic material such as polyester. Such materials would conform itself to the anatomy of the player and may dampen any blows that might occur on the upper shell 22 or lower shell 24. The liner 16 may also be slightly oversized with respect to the upper and lower shells 22, 24 such that the liner 16 may further envelop and protect areas of the player that are not substantially covered by the upper and lower shells 22, 24. It is understood that the liner 16 may be omitted if the upper and lower shells 22, 24 are made, for example, of a rigid outer layer and a soft inner layer affixed to the rigid outer layer.

The band 18 extends along part of a periphery of the upper shell 22 and part of a periphery of the lower shell 24, the band 18 interconnecting the upper shell 22 and the lower shell 24 to one another. In one embodiment, the band 18 extends along the entire periphery of the assembled upper shell 22 and lower shell 24. In another embodiment, the band 18 may extend along a portion of the peripheries of the upper shell 22 and lower shell 24.

The band 18 may be a strip of fabric such as a woven stretchable fabric. The band 18 may also be a braiding.

Figure 4A:
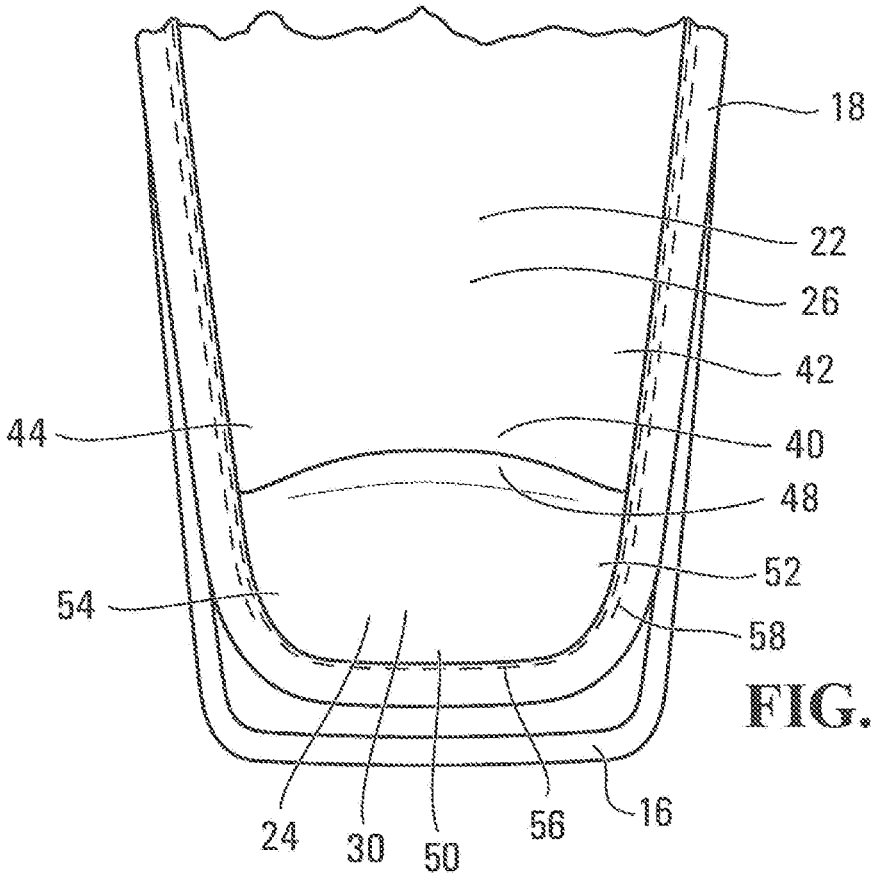
FIG. 4A is an enlarged front view of the bottom portion of the leg pad showing the upper shell, the lower shell, the liner, the band and the stitching lines.
Figure 4B:
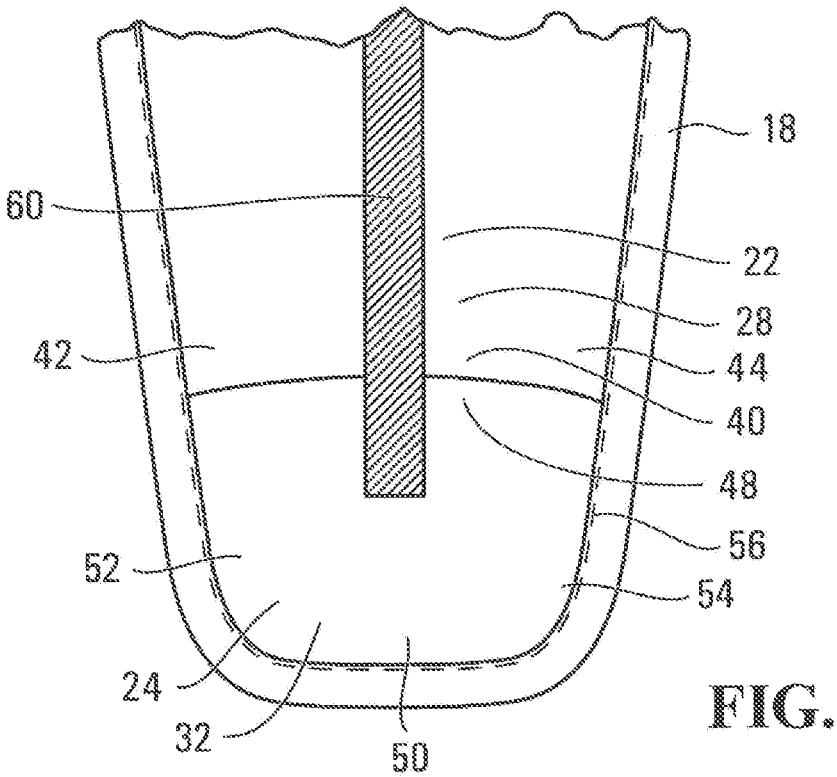
FIG. 4B is an enlarged rear view of the bottom portion of the leg pad showing the upper shell, the lower shell, the strap, the band and the stitching line.
Figure 5A:
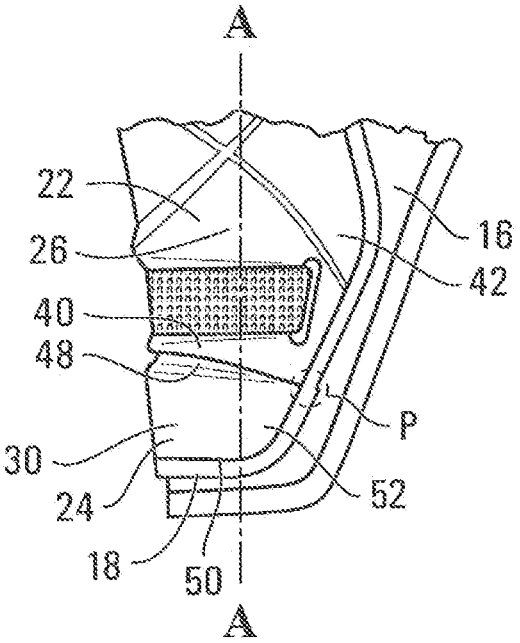
FIG. 5A is an enlarged side view of the bottom portion of the leg pad showing the lower shell in the first position.
Figure 5B:
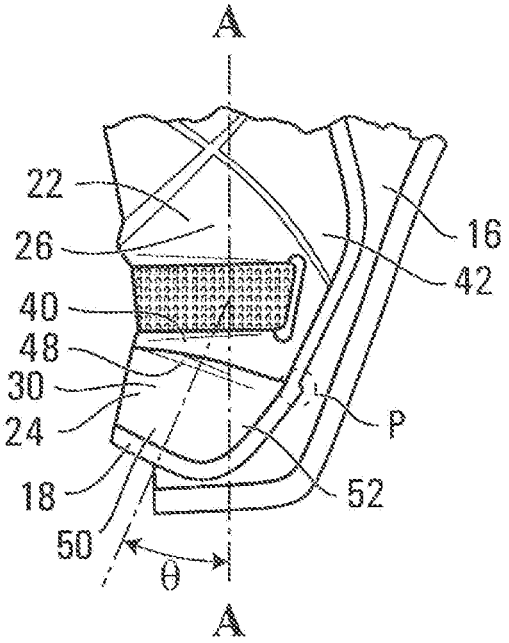
FIG. 5B is an enlarged side view of the bottom portion of the leg pad showing the lower shell in the second position.

The band 18 may have a width large enough to cover at least partially the outer and inner sides and edges of the upper and lower shells 22, 24. As shown in FIGS. 4A and 4B, the band 18 is wide enough to cover a portion of the outer and inner sides 26, 28 and the left and right edges 42, 44 of the upper shell 22 and a portion of the outer and inner sides 30, 32 and the left, right and bottom edges 52, 54, 50 of the lower shell 24. Moreover, as best shown in FIGS. 4A, 5A and 5B, the bottom edge 40 of the upper shell 22 and the top edge 48 of the lower shell 24 are free of the band 18 such that these edges may move relative to one another.

The leg pad 10 may comprise a stitching line 56 passing through the band 18 and the upper shell 22 and passing through the band 18 and the lower shell 24 in order to affix the band 18 to the upper and lower shells 22, 24 such that the band 18 interconnects the upper shell 22 and the lower shell 24 to one another.

It is however understood that the affixation of the band 18 to the upper shell 22 and the lower shell 24 is not limited to such stitching. For example, in another embodiment, the band 18 may be affixed to the upper shell 22 and the lower shell 24 via an adhesive or any other affixing means known in the art.

Furthermore, the band 18 may be attached to the peripheries of the upper shell 22 and the lower shell 24 such that the band 18 biases the lower shell 24 towards the first position. Such a bias would avoid that the lower shell 24 undesirably remain in the second position even after the player has extended his/her foot.

The leg pad 10 may also comprise a stitching line 58 passing through the band 18 and the upper shell 22 and liner 16 and passing through the band 18 and the lower shell 24 and liner 16 in order to affix the assembled upper shell 22 and lower shell 24 to the liner 16 such that the band 18 also interconnects the upper and lower shells 22, 24 to the liner 16.

Figure 6A:
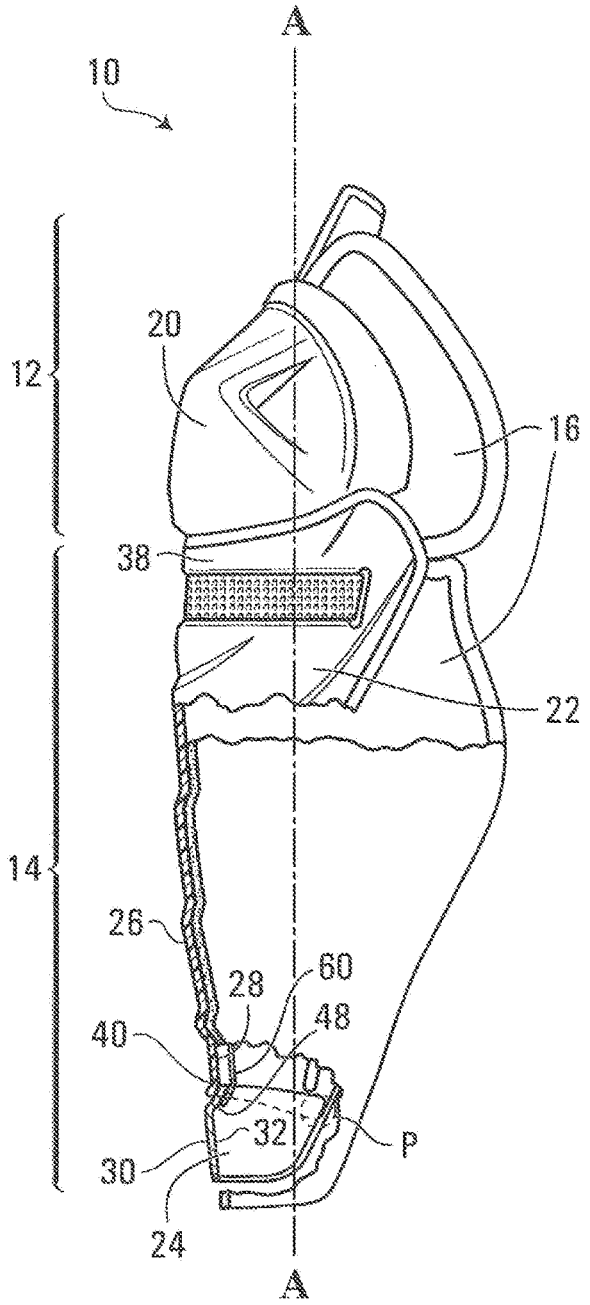
FIG. 6A is a side view of the leg pad showing a partial cross section of the lower portion of the leg pad and the lower shell in the first position.
Figure 6B:
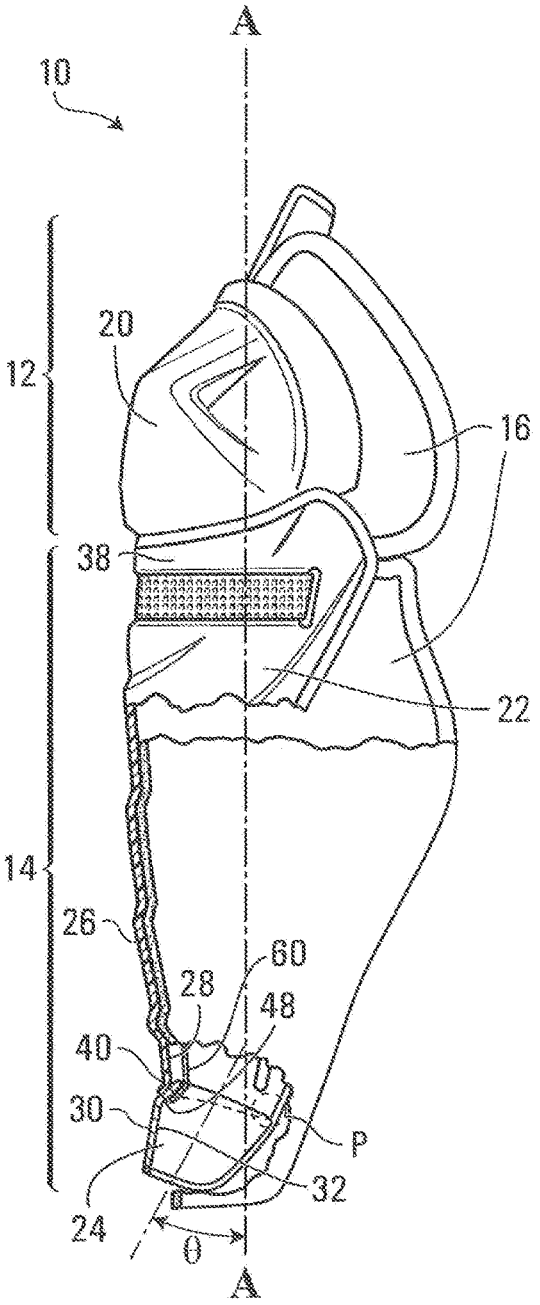
FIG. 6B is a side view of the leg pad showing a partial cross section of the lower portion of the leg pad and the lower shell in the second position.

In either case, the lower shell 24 is movable relative to the upper shell 22 in response to a flexion motion of the player's ankle. As best shown in FIGS. 5A, 5B, 6A and 6B, the movement induced by the flexion movement of the player's ankle will cause the lower shell 24 to move from a first position to a second position. As best shown in FIGS. 5A and 6A, when the lower shell 24 is in the first position, the lower shell 24 may be in an extended position where it extends generally parallel to the longitudinal axis A-A of the leg pad such that the upper and lower shells 22, 24 are generally straight or rectilinear. As best shown in FIGS. 5B and 6B, when the lower shell 24 moves from the first position to the second position in response to the flexion motion of the player's angle, the lower shell 24 then pivots about a pivot region P and defines an angle θ relative to the longitudinal axis A-A of the leg pad. Hence, in the second position, the lower shell 24 may be in a retracted or angled position where it extends along an axis that defines an angle θ relative to the longitudinal axis A-A. In one embodiment, the angle θ relative to the longitudinal axis may be up to 10°. In another embodiment, the angle θ relative to the longitudinal axis may be up to 15°. It is understood that the movement of the lower shell 24 relative to the upper shell 22 may be a combination of a pivotable movement and a slight translation movement that is allowed, for example, by the stretchability of the band 18 (see the band 18 in the pivot region P).

As shown in FIG. 6A, when the lower shell 24 is in the first position, the upper and lower shells 22, 24 are positioned relative to one another to avoid a gap therebetween. More particularly, in the first position, there is a first overlap between the bottom edge 40 of the upper shell 22 and the top edge 48 of the lower shell 24. In the first position, the first overlap, when measured along the longitudinal axis A-A, may be between 2 mm and 12 mm. In another embodiment, this first overlap may be between 5 mm and 10 mm. When the lower shell 24 is in the second position, as shown in FIG. 6B, there is a second overlap between the bottom edge 40 of the upper shell 22 and the top edge 48 of the lower shell 24, the second overlap being greater than the first overlap. In the second position, the second overlap, when measured along the longitudinal axis A-A, may be between 5 mm and 20 mm. In another embodiment, this second overlap may be between 15 mm and 20 mm. As best shown in FIGS. 5A, 5B, 6A and 6B, the bottom edge 40 of the upper shell 22 overlaps the top edge 48 of the lower shell 24 in order to avoid a gap when the lower shell 24 moves from the second position to the first position.

Figure 7:
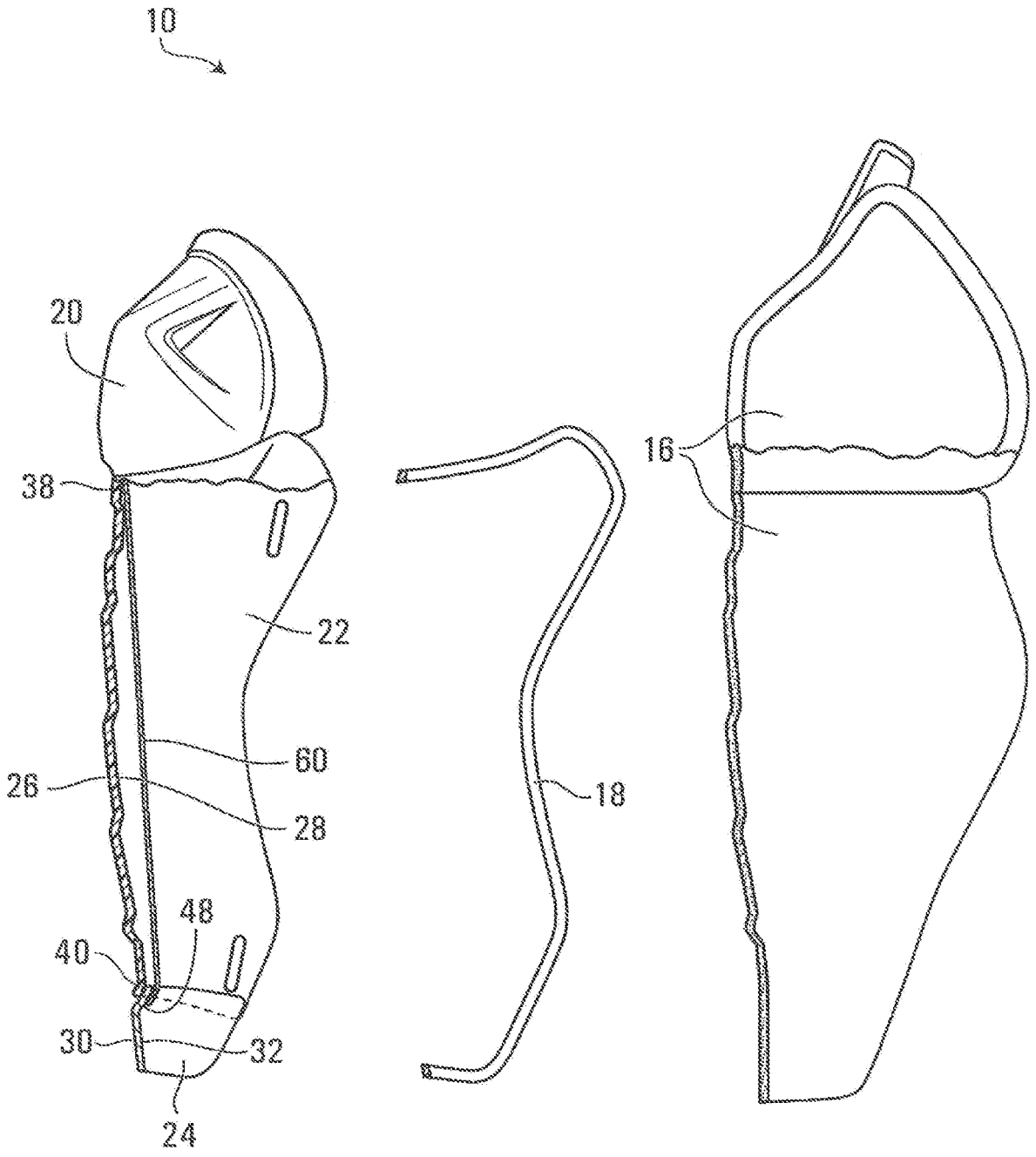
FIG. 7 is a side exploded view of the leg pad showing a cross section of the lower portion of the leg pad.

As best shown in FIGS. 4B and 7, the leg pad 10 may comprise a strap 60 which connects the upper shell 22 and the lower shell 24. The strap 60 may be connected to the inner sides 28, 32 of the upper and lower shells 22, 24. The strap 60 may restrict the top edge 48 of the lower shell 24 from moving over the bottom edge 40 of the upper shell 22. The strap 60 may also ensure that the lower shell 24 remains generally parallel to the longitudinal axis A-A of the leg pad 10 when pressure is applied on the lower shell for moving/pivoting the lower shell 24 inwardly (for example, in a direction towards a player's ankle).

Although various embodiments have been illustrated, this was for the purpose of describing, but not limiting, the invention. Various changes, modifications and enhancement may be made to the embodiments and the scope of the claims should not be limited by the embodiments, but should be given the broadest interpretation consistent with the description as a whole.

The invention claimed is:

1. A leg pad for a hockey player, comprising:

a plurality of shell elements for protecting different parts of a leg, each of the shell elements having an outer surface exposed to game objects and an inner surface adapted to face the leg, each of the shell elements comprising a first material;

a liner facing the inner surface of the shell elements, the liner comprising a second material, the first material being more rigid than the second material; and affixing means connecting the liner to the shell elements;

wherein the affixing means is configured to allow movement of the shell elements relative to one another and relative to a portion of the liner adapted to face part of the leg protected by at least one of the shell elements in response to flexion of said part of the leg while the leg pad is attached to the leg, wherein said movement of the shell elements relative to one another comprises a pivotable movement and a translational movement.

2. The leg pad of claim 1, wherein a knee cap is disposed over a knee portion of the leg.

3. The leg pad of claim 1, wherein said shell elements comprise a lower shell element configured to overlie at least partially a shin and an ankle portion of the leg.

4. The leg pad of claim 3, wherein said shell elements comprise an upper shell element between the knee cap and the lower shell element.

5. The leg pad of claim 1, wherein a band extends along part of a periphery of said shell elements, said band connecting said shell elements and said liner.

6. The leg pad of claim 4, wherein said shell elements comprise an overlap between the knee cap and the upper shell element where a portion of the upper shell element is distal relative to a portion of the knee cap.

7. The leg pad of claim 6, wherein said shell elements comprise an overlap between the lower shell element and the upper shell element where a portion of the upper shell element is distal relative to a portion of the lower shell element.

8. The leg pad of claim 4, wherein a pivot region of the upper shell element relative to the lower shell element is located away from a front of the leg pad.

9. The leg pad of claim 4, wherein said lower shell element moves to a first position, generally extending parallel to a longitudinal axis of the leg pad such that the lower and upper shell elements are straight or rectilinear.

10. The leg pad of claim 9, wherein said lower shell element moves to a second position defining an angle relative to the longitudinal axis of the leg pad, where the lower shell element is in a retracted or angled position.

11. The leg pad of claim 10, wherein said upper shell element said lower shell element overlap when said lower shell element is in the second position.

12. A leg pad for a hockey player, the leg pad extending along a longitudinal axis and comprising:

a plurality of shell elements for protecting different parts of a leg of a wearer, each of the shell elements having an outer surface exposed to game objects and an inner surface adapted to face the leg, each of the shell elements comprising a first material, the shell elements comprising an upper shell element and a lower shell element:

a knee cap for protecting a knee joint and part of a shin of the player:

an upper region adapted for at least partially covering a knee joint and an upper part of a shin of the player;

a lower region adapted for at least partially covering a lower part of the shin and an ankle of the hockey player;

wherein at least part of a first subset of the shell elements and the knee cap cover the upper region of the leg pad and at least part of a second subset of the shell elements and the knee cap cover the lower region of the leg pad a liner facing an inner surface of the shell elements, the liner comprising a second material and being connected to the shell elements by affixing means; and a band extending along part of a periphery of said shell elements, said band connecting said shell elements and said liner;

wherein the first material is more rigid than the second material;

wherein the affixing means is configured to allow the shell elements of the upper and lower portions to be movable relative to a first portion of the liner configured to overlie a first member of the hockey player's leg when the hockey player wears the leg pad and flexes the first member; and wherein the affixing means is configured to allow the shell elements of the lower portion to be movable relative to one another and relative to a second portion of the liner configured to overlie a second member of the hockey player's leg when the hockey player wears the leg pad and flexes the second member.

13. The leg pad of claim 12, wherein the first subset of the shell elements and the knee cap comprises the knee cap and the upper shell element and the second subset of the shell elements and the knee cap comprises the upper shell element and the lower shell element.

14. A leg pad for attachment to a leg, comprising:

an upper shell and a lower shell for protecting different parts of the leg; and a liner at least partially adapted to face a part of the leg protected by the lower shell;

wherein the liner interconnects the upper and lower shells;

a band extending along part of a periphery of said upper and lower shells, said band connecting said shells and said liner; and wherein the lower shell is movable relative to the upper shell between a first position and a second position in response to flexion of at least part of the leg while the leg pad is attached to the leg; and wherein, in the first position, the upper and lower shells overlap and define a first overlap, and in the second position, the upper and lower shells overlap and define a second overlap, the second overlap being greater than the first overlap.

15. The leg pad of claim 14, wherein a knee cap is disposed over a knee portion of the leg.

16. The leg pad of claim 15, wherein said shells comprise an overlap between the knee cap and the upper shell where a portion of the upper shell is distal relative to a portion of the knee cap.

17. The leg pad of claim 16, wherein said shells comprise an overlap between the lower shell and the upper shell where a portion of the upper shell is distal relative to a portion of the lower shell.

18. The leg pad of claim 14, wherein the lower shell is configured to overlay at least partially a shin and an ankle portion of the leg.

19. The leg pad of claim 15, wherein the upper shell is disposed between the knee cap and the lower shell.

20. A leg pad for attachment to a leg, comprising:

an upper shell and a lower shell for protecting different parts of the leg; and a liner at least partially adapted to face a part of the leg protected by the lower shell;

wherein the liner interconnects the upper and lower shells; and a band extending along part of a periphery of said upper and lower shells, said band connecting said shells and said liner;

wherein the lower shell is movable relative to the upper shell between a first position and a second position in response to flexion of at least part of the leg while the leg pad is attached to the leg; and wherein the upper and lower shells overlap such that the lower shell is at least partially between the upper shell and the liner both in the first position and in the second position.

21. The leg pad of claim 20, wherein a knee cap is disposed over a knee portion of the leg.

22. The leg pad of claim 20, wherein the lower shell is configured to overlie at least partially a shin and an ankle portion of the leg.

23. The leg pad of claim 22, wherein the upper shell is between the knee cap and the lower shell.

* * * * *